United States Patent [19]

Antonioni

[11] 4,143,865

[45] Mar. 13, 1979

[54] FLASH SMELTING FURNACE

[75] Inventor: Thomas N. Antonioni, Sudbury, Canada

[73] Assignee: The International Nickel Company, Inc., New York, N.Y.

[21] Appl. No.: 884,231

[22] Filed: Mar. 7, 1978

[30] Foreign Application Priority Data

Jul. 4, 1977 [CA] Canada ..... 281906

[51] Int. Cl.[2] ..... F27B 3/24

[52] U.S. Cl. ..... 266/161; 266/192

[58] Field of Search ..... 13/32; 75/72–74, 75/86; 266/161, 162, 164, 171, 172, 182, 186, 190, 192, 241

[56] References Cited

U.S. PATENT DOCUMENTS 2,668,107 2/1954 Gordon et al. ..... 75/74

3,511,643 5/1970 Vallak et al. ..... 266/190

3,777,043 12/1973 O'Neill ..... 13/32

FOREIGN PATENT DOCUMENTS 151362 9/1961 U.S.S.R. ..... 266/186

OTHER PUBLICATIONS

Journal of Metals; Jun. 1955, pp. 742–750.

*Primary Examiner*—Gerald A. Dost

*Attorney, Agent, or Firm*—Lewis Messulam; Ewan C. MacQueen

[57] ABSTRACT

A flash smelting furnace has an outer metallic shell from which portions are cut out to expose the outer surface of the refractory lining at a depth corresponding to the location of the matte-slag interface, and gaseous cooling jets are directed onto the exposed refractory lining.

7 Claims, 4 Drawing Figures

FLASH SMELTING FURNACE

BACKGROUND OF THE INVENTION

The present invention relates to improved apparatus for flash-smelting sulfidic ores and concentrates.

The process of flash-smelting, as is well known, entails injecting a sulfidic material into a furnace space with the aid of a stream of oxidizing gas, through appropriately designed burners, so that the injected feed "burns" while it is in a suspended state within the furnace chamber. The types of apparatus which have been designed for carrying out flash-smelting on a commercial scale can be divided for convenience into two general categories, namely furnaces which employ vertically disposed burners and those in which the burners are horizontally disposed. A well-known furnace design of the vertical burner type can be described as a generally U-shaped vessel consisting of a horizontal trough portion and two vertical limb portions. One or more burners are fitted at the upper extremity of one of the limb-portions and directed vertically downwards along the limb axis so that this particular limb defines the space within which burning of the feed takes place. The resulting liquid matte and slag collect as a pool within the trough portion of the furnace, while the other vertical limb of the furnace constitutes the offtake through which exhaust gases exit. In such apparatus the gas used to inject the feed is usually air or oxygen-enriched air, and additional burners are provided for injecting fuel to achieve and maintain the desired smelting temperature.

A furnace design of the second, i.e., horizontal burner, type is described in detail in the paper: "Oxygen flash smelting swings into commercial operation", Journal of Metals (1955) pp 742–750. This type of furnace, with which applicant has been associated for some time, is operated in a fully autogenous manner by using commercially pure (i.e., at least 95%) oxygen to inject the feed. Aside from obviating the need for additional fuel to maintain the smelting temperature, this method of operation offers the advantage of exhaust gases which are more concentrated in sulfur dioxide than would be the case if air were used instead of oxygen. The flue gases are therefore of a lower volume and also more amenable to recovery of the sulfur dioxide therefrom. The furnace construction, which is described in more detail hereinafter, is such as to define a chamber in the shape of a rectangular room with an arched ceiling. The burners are provided in the shorter of the side-walls, while the exhaust offtake is provided in the arched furnace-roof. In operation a pool of matte is formed in the furnace and tapped through an appropriate tap-hole in a long side-wall whereas a supernatant layer of slag is tapped as necessary through an appropriate tap-hole in one of the shorter side-walls, i.e. an end wall.

One important factor in the operation of the above-mentioned horizontal burner furnace has been the life of the refractory lining of the furnace. Gradual erosion of the refractory walls results in their eventual breakdown and necessitates expensive shut-down and rebuilding procedures. The erosion is most severe in the region of the side walls which in operation is contacted by the slag-matte interface. The erosion problem is aggravated by the tendency for an encrustation of magnetite to build up on the upper regions of the side walls. As a result of this combination of weakening of the lower region of the walls and build-up of magnetite on their higher regions, the walls eventually topple-over into the chamber. In order to offset this, the side walls have been built of graded thickness to provide substantially more refractory in the lower part thereof which houses the pool of matte and supernatant slag. Despite this, however, it has not hitherto been possible to operate the furnace for more than about 10–12 months without shutting it down to rebuild the lining.

It is an object of the present invention to provide a horizontal burner furnace of improved design wherein the life of the refractory lining is maximized.

SUMMARY OF THE INVENTION

According to the invention a flash-smelting furnace is provided having a refractory lining which defines a chamber within which, in operation, autogenous smelting takes place and a pool of molten matte and supernatant slag are contained, an outer metallic shell which encloses the lining, a plurality of burners extending generally horizontally from the exterior of the furnace to the chamber through apertures in the shell and lining, and an offtake aperture in the roof of the shell and lining through which, in operation, exhaust gases exit from the chamber, wherein the improvement comprises means for directing gaseous cooling jets to impinge upon the external surface of the refractory walls at a plurality of horizontally spaced locations so selected that the refractory walls are cooled substantially along the whole of the perimeter thereof at a vertical level which corresponds substantially to the level at which the matte-slag interface is maintained in operation.

The cooling, at the slag-matte interface level, of the side walls is achieved by the direct impingement of cooling gases, e.g. compressed air, onto the outer surface of the refractory lining. This is far more effective than any attempts to achive local cooling of the lining by means of water jackets fitted to or integral with the metallic shell of the furnace. In a preferred embodiment of the invention the cooling is achieved by providing cut-outs in the furnace shell, such as to expose the outer surface of the refractory bricks. The cut out portions are arranged next to one another so that they define together a discontinuous slot extending over the whole perimeter of the furnace at the appropriate vertical level. The cut out portions represent in total two thirds or more of the slot length. A system of tuyeres fitted in the vicinity of the slot is used to direct jets of compressed air onto the bricks at a series of spaced points around the furnace perimeter.

It should be pointed out that the provision of a long slot cut out of the furnace shell is a distinct departure from accepted furnace design. This is because it has always been felt essential to ensure that the metallic furnace shell effectively encases the whole of the brick lining for fear of leaks through interstices in the lining. We have found however that some magnetite deposition on the furnace walls is inevitable in operation, and this magnetite coating provides an adequate gas-tight sealing on the inner surface of the refractory lining. As a result it is possible to remove substantial portions of the metallic shell and thus expose the outer surface of the refractory for cooling the latter.

According to a preferred feature of the invention the burners through which the solids feed is injected are mounted in the side-walls of the furnace with the longitudinal axis of each burner at a small angle to the horizontal such that the jet of solids and air is aimed slightly downwards in the direction of the pool of matte and slag in the furnace. In this way build-up of magnetite encrustation on the upper regions of the side-walls is minimized. We have found that in a furnace having four burners, two of which are inserted through each of a pair of opposed side-walls, a satisfactory configuration entails slanting each burner at an angle of the order of about 3° from the horizontal. It is also preferred to have the axes of a pair of adjacent burners (i.e., a pair fitted in the same side-wall) convergent rather than parallel to one another. By positioning the four burners such that the axis of each is inclined at about 3° to the horizontal and such that the axes of an adjacent pair are at about 10° to one another, the trajectories of the jets from the burners are in effect aimed at a target area located above the slag surface and directly below the furnace offtake.

It will be understood that the reference herein to burners which are horizontally mounted is intended to include the above-described slightly slanted burner arrangement, and reference to the burner axis denotes the direction along which feed is discharged by the burner. The method of mounting a burner in a side-wall has conventionally consisted of inserting it into a hole in the refractory relying on the degree of fit of the burner in the hole to ensure the desired alignment. A problem with this arrangement is that the hole in the refractory is subject to wear and, on widening of the hole, misalignment of the burner results. Therefore in accordance with a preferred feature of the invention burner alignment means are provided to maintain the necessary alignment. Such alignment means can conveniently consist of a collar, which can slip over the end of the burner remote from the furnace, and which is attached by a chain to a suitable point on the furnace shell. In this way the collar and chain act as a guy-rope to position the burner at the desired angle.

BRIEF DESCRIPTION OF THE DRAWINGS

A preferred embodiment of the invention will now be described with reference to the accompanying drawings in which.

DETAILED DESCRIPTION OF THE DRAWINGS

Figure 1:
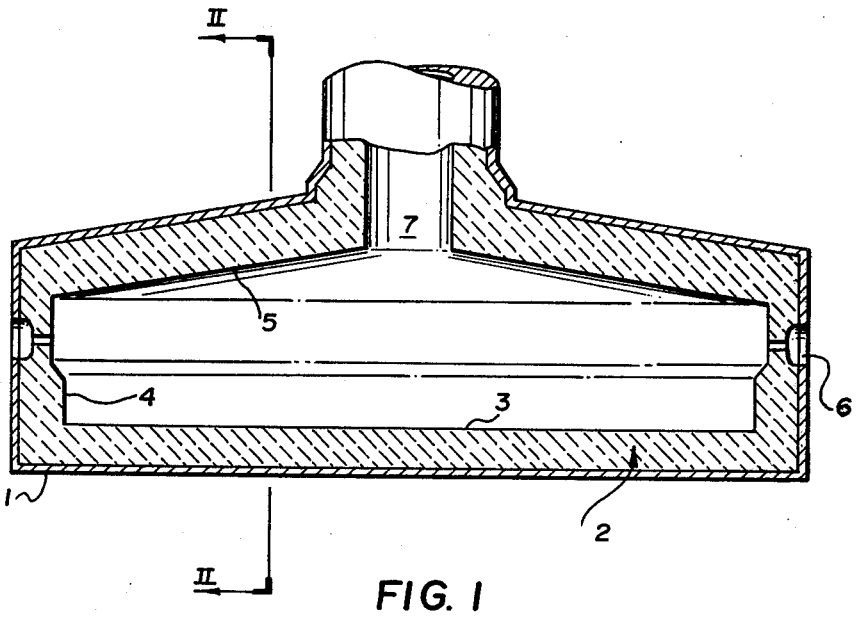
FIG. 1 is a schematic cross sectional view of a prior art flash smelting furnace.
Figure 2:
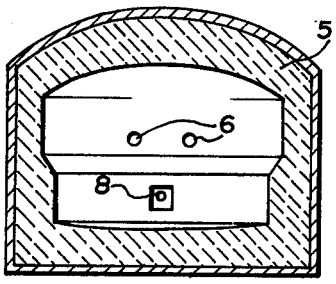
FIG. 2 is a cross section along the line II—II of FIG. 1.

The furnace design shown in FIGS. 1 and 2 is that which is described in detail in the above-mentioned Journal of Metals paper. It consists of a metallic housing or shell 1 which is lined with a refractory brick assembly 2. The refractory lining can be referred to for convenience as consisting of a hearth portion 3, vertical side-walls 4 and a roof-portion 5 which, as can be seen from FIG. 2, is arched. Each of the opposed end walls is provided with apertures 6 through the shell and lining, each aperture being shaped and dimensioned to house a burner (not illustrated). An offtake 7 is provided in the furnace roof through which flue-gases exit from the furnace and are conducted to a settling chamber. The side walls, i.e the end walls shown in FIG. 1 as well as the longitudinal side walls shown in FIG. 2, are constructed of graded thickness so that a substantially thicker refractory layer is available at a lower region of these walls. In operation matte is tapped through tap holes (not illustrated) in a longitudinal side wall of the furnace, while slag is removed via a tap hole 8 in an end wall of the furnace.

Figure 3:
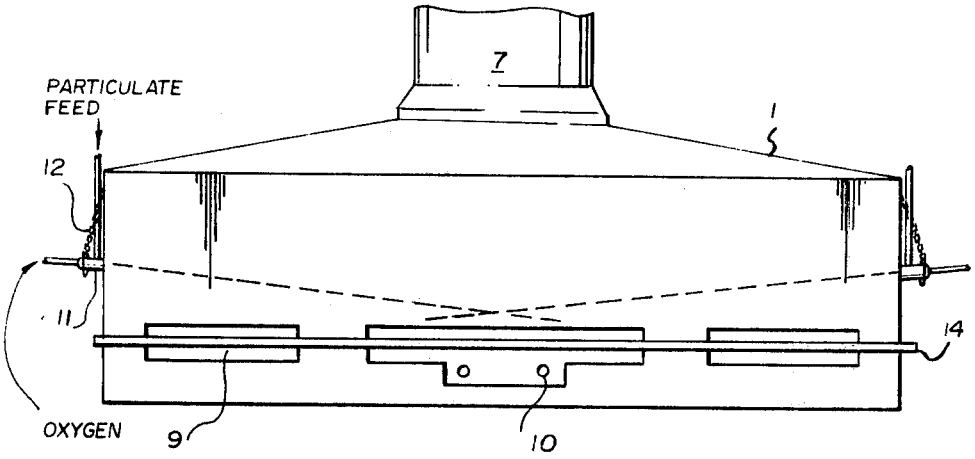
FIG. 3 is a side view of the exterior of a flash furnace according to the invention.
Figure 4:
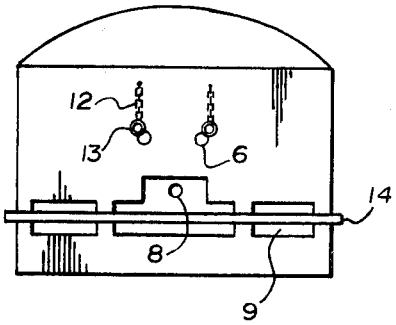
FIG. 4 is an end view of the furnace of FIG. 3 with the burners removed.

Referring now to FIGS. 3 and 4, the improved furnace illustrated is similar in most respects to that of FIGS. 1 and 2; identical numerals are therefore used to designate the corresponding like components and only the differences between the furnaces will be described below. The furnace shell, shown in side view in FIG. 3 and in end view in FIG. 4, is provided with cut-out portions 9 which define a slot-like opening extending over substantially the whole perimeter of the furnace. A wider portion of the slot 9 surrounds the matte tapping holes 10. Partially shown in FIG. 3 are two of the four burners 11 with which the furnace is equipped. Each burner is connected to an oxygen line and a particulate feed line which supplies the mixture of sulfide concentrate and fluxing agents to be carried by the oxygen stream. Each burner is strapped into position with the aid of a burner alignment assembly which consists of a chain 12 attached at one end to the furnace shell 1 and equipped at the other end with a collar 13 (FIG. 4) which in operation surrounds and engages with the extremity of a burner to support it in the desired orientation.

As is shown by FIG. 4, where the burners are absent, the chain and collar assembly is so dimensioned and positioned as to urge the outer extremity of a burner supported by it upwards and away from the burner adjacent thereto. As a result, the longitudinal axis of a supported burner is inclined in the manner indicated by the broken lines of FIG. 3, and the axes of all four of the burners intersect one another within a relatively confined area directly below the offtake of the furnace.

A tuyere assembly indicated by 14 surrounds the furnace close to the cooling slot 9, and discharges compressed air onto the exposed surface of the refractory lining. As will be evident from the relationship between the levels of the tuyeres 14 and the matte and slap tapping holes 10 and 8 respectively, the cooled region of the refractory lining represents the region within which the matte-slag interface in the furnace is maintained in operation.

A full size commercial furnace of the design illustrated in FIGS. 3 and 4 was used for testing the effectiveness of the improved design. The furnace, which had a smelting capacity of about 1500 tonnes per day of concentrate was about 24 meters long, 7 meters wide and 5.5 meters to the apex of its arched roof. It was provided with a cooling cut-out which exposed an area about 3.7 meters long and 1.2 meters wide surrounding the matte tapping hole, and a discontinuous slot about 50 cm. wide around the remainder of the furnace perimeter. Over this exposed area of refractory compressed air was injected at a gauge pressure of about 100 Kilopascals. The furnace was operated continuously for a period of 22 months after which time it was shut down for reasons unrelated to refractory wear. On inspection the refractory lining was found to be still in good condition, showing that the combined features of slag line cooling and burner alignment result in an increase of 100% or more in the life of the refractory lining.

While the benefits of the invention have been described with reference to a rectangular furnace employing four burners, it will be understood that the invention may be embodied in furnaces of square, circular or oval horizontal cross-section, and that such furnaces may incorporate a higher or lower number of burners. Thus many modifications may be made to the details of the furnace described without departing from the scope of the invention, which is defined by the appended claims.

I claim:

1. A flash smelting furnace having a refractory lining which defines a chamber within which, in operation, autogenous smelting takes place and a pool of molten matte and supernatant slag are contained, an outer metallic shell which encloses the lining, a plurality of burners extending generally horizontally from the exterior of the furnace to the chamber through apertures in the shell and lining, and an offtake aperture in the roof of the shell and lining through which, in operation, exhaust gases exit from the chamber, wherein the shell is provided with a plurality of cut-out portions which together define a discontinuous slot extending substantially along the whole of the perimeter of the walls thereof, to expose the external surface of the refractory walls at a vertical level which corresponds substantially to the level at which the matte-slag interface is maintained in operation, and means are provided for directing gaseous cooling jets to impinge on the exposed external surface of the refractory walls at a plurality of horizontally spaced locations along the discontinuous slot.

2. A furnace as claimed in claim 1 in which tuyere means are provided adjacent the slot to inject compressed air onto the portions of the refractory wall to be cooled.

3. A furnace as claimed in claim 1 which includes a plurality of burner alignment means each of which is associated with a respective one of the burners, and is adapted to maintain the burner such that, in operation, feed is injected in a slightly downward direction at an acute angle to the horizontal.

4. A furnace as claimed in claim 3 in which the burner alignment means are adapted to aim all of the burners such that the longitudinal axes of the burners intersect one another within an area vertically below the offtake aperture of the furnace.

5. A furnace as claimed in claim 4 in which the chamber is of generally rectangular horizontal cross section and the burners are mounted at substantially the same vertical level, in two opposing vertical walls of the furnace.

6. A furnace as claimed in claim 3 in which each of the burner alignment means comprises a support member secured to the furnace shell and adapted to engage a respective burner at or close to the burner extremity remote from the furnace chamber.

7. A furnace as claimed in claim 6 in which the support member consists of a chain one end of which is secured to the furnace shell, the other end of the chain having a collar which is so dimensioned that it can encircle the burner extremity.

* * * * *